US012152449B1

(12) United States Patent
Chen et al.

(10) Patent No.: US 12,152,449 B1
(45) Date of Patent: Nov. 26, 2024

(54) CONSTANT LOAD CLAMPING APPARATUS OF INJECTOR HEAD OF COILED TUBING DRILLING MACHINE AND DESIGN METHOD THEREOF

(71) Applicant: Beijing Goaldrill Technology Co., Ltd., Beijing (CN)

(72) Inventors: Jiaqi Chen, Beijing (CN); Yanfeng Shi, Beijing (CN); Xiaoming Cao, Beijing (CN)

(73) Assignee: BEIJING GOALDRILL TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 18/623,596

(22) Filed: Apr. 1, 2024

(30) Foreign Application Priority Data

Nov. 9, 2023 (CN) ..... 202311485923.6

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 6,216,780 B1 * 4/2001 Goode ..... E21B 19/22 166/85.5
6,892,810 B2 * 5/2005 Austbo ..... E21B 19/22 226/173
10,787,870 B1 * 9/2020 Fulks ..... E21B 19/22

FOREIGN PATENT DOCUMENTS

CN 110410026 A * 11/2019 ..... E21B 21/085
CN 116752955 A * 9/2023
WO WO-2014174287 A2 * 10/2014 ..... E21B 19/22

* cited by examiner

*Primary Examiner* — Matthew R Buck
(74) *Attorney, Agent, or Firm* — MUNCY, GEISSLER, OLDS & LOWE, P.C.

(57) ABSTRACT

A constant load clamping apparatus of injector head of coiled tubing drilling machine, wherein the apparatus comprises: a ropeslice-ropeslice-rope structure, wherein a first connection piece and a second connection piece are connected at both ends of the ropeslice-rope structure;

a first slice and a second slice are symmetrically provided in the ropeslice-rope structure, the first slice and the second slice are provided in parallel, a rope is provided in between the first slice and the second slice, an end of the first slice, an end of the second slice, and an end of the rope are fixed at a first fixing position of the first connection piece and another end of the first slice, another end of the second slice and another end of the rope are connected at a second fixing position of the second connecting piece.

4 Claims, 13 Drawing Sheets

CONSTANT LOAD CLAMPING APPARATUS OF INJECTOR HEAD OF COILED TUBING DRILLING MACHINE AND DESIGN METHOD THEREOF

TECHNICAL FIELD

The present invention belongs to the technical field of mechanical clamping apparatuses, especially a constant load clamping apparatus of injector head of coiled tubing drilling machine and design method thereof.

BACKGROUND TECHNOLOGY

Injector heads comprise generally components such as racks, hydraulic motors, counter trains, coiled tubing slips, towing chains, tensioning devices, compacting devices, idlers and load cells. Main functions of the racks are to house accessories, such as the sprocket wheels, hydraulic motors and compacting devices of the injector heads; the hydraulic motors provide power for driving the chains and coiled tubing transportation; the tensioning devices and the compacting devices serve primarily to tension the chains and drive the slips to enclasp the coiled tubing; the counter trains are employed to measure downhole lengths of the coiled tubing; the load cells are configured to measure the drilling pressure. Usually, inner diameters of the slips outside the chains match outer diameters of the coiled tubing, and are employed to hold the coiled tubing and tow the coiled tubing to make vertical movements along with the drive chains.

Developments on coiled tubing apparatus abroad start early, and the technical levels are mature and advanced. Manufacturers of coiled tubing injector heads abroad are NOV Hydra Rig, Stewart & Stevenson and ASEP, the D series injector head made by Stewart & Stevenson has a specifically designed "floating" tensioning system, wherein tensioning is automatically done, very low speed can be realized, and the tensioning system is suitable for use in coiled tubing with a diameter ranging from 25.4 mm (1 inch) to 114.3 mm (4.5 inches), the 353 KN four-drive K-COIL Quad-Head 80 H injector head developed by ASEP has a volume of only a half of that of similar products, and the injector head is designed with four chain drives, so as to increase lifting capacities of the injector head and reduce damage on the coiled tubing due to clamping of the injector head.

However, structures of solutions to render the injector head clamping abilities with hydraulic cylinders are complex, and the injector head has to give additional control to the hydraulic cylinders to realize stable clamping, and during work, there is a risk of inabilities.

SUMMARY OF THE INVENTION

Embodiments of the present invention aim to provide a constant load clamping apparatus for injector head of coiled tubing drilling machine and a design method thereof, and aim to solve the problem that, the structures of solutions rendering the injector head clamping abilities with hydraulic cylinders are complex, the injector head has to give additional control to the hydraulic cylinders to realize stable holding, and during work, there is a risk of inabilities.

Embodiments of the present invention are realized in the following ways, a constant load clamping apparatus of injector head of coiled tubing drilling machine, wherein the apparatus comprises:

A ropeslice-rope structure, wherein a first connection piece and a second connection piece are connected at both ends of the ropeslice-rope structure;

A first slice and a second slice are symmetrically provided in the ropeslice-rope structure, the first slice and the second slice are provided in parallel, a roperope is provided in between the first slice and the second slice, an end of the first slice, an end of the second slice, and an end of the rope are fixed at a first fixing position of the first connection piece and another end of the first slice, another end of the second slice and another end of the rope are connected at a second fixing position of the second connecting piece.

Another purpose of the present invention is to provide a design method of constant load clamping apparatus of injector head of coiled tubing drilling machine, wherein the method comprises the following steps:

- Building a dynamics model for the clamping apparatus;
- Obtaining generalized coordinate vectors, total kinetic energy and total potential energy of the dynamics model based on the dynamics model;
- Calculating generalized forces of the generalized coordinate vectors, obtaining the generalized forces contributed by restraint conditions by a Lagrange multiplier and gradients of the restraint conditions on the generalized coordinate vectors;
- Obtaining dynamics equations of the dynamics model based on the generalized forces, the generalized forces contributed by the restraint conditions and the restraint conditions of the generalized coordinate vectors;
- Writing the dynamics equations to be general differential algebraic equations by introducing signs;
- Iterating and solving the differential algebraic equations by a backward difference method, and obtaining movement tracks and deformation status information of the clamping apparatus.

For the constant load clamping apparatus of injector head of coiled tubing drilling machine provided in the embodiments of the present invention, a parameterized and accurately described dynamics model is used to simulate and evaluate performance indicators of the apparatus, and in combination with trust region constraint algorithms the dynamic design of the apparatus is realized, the apparatus has excellent dynamic performance, and conforms to overall design requirements of injector heads. With simple ropeslice-rope structures, reliable constant load clamping is realized, and damage of the coiled tubing due to heavy load is avoided. Furthermore, the present apparatus is characterized in being static at higher positions and dynamic at lower positions, good vibration damping effects can be achieved so that service life of the injector heads is improved.

Figure 1:
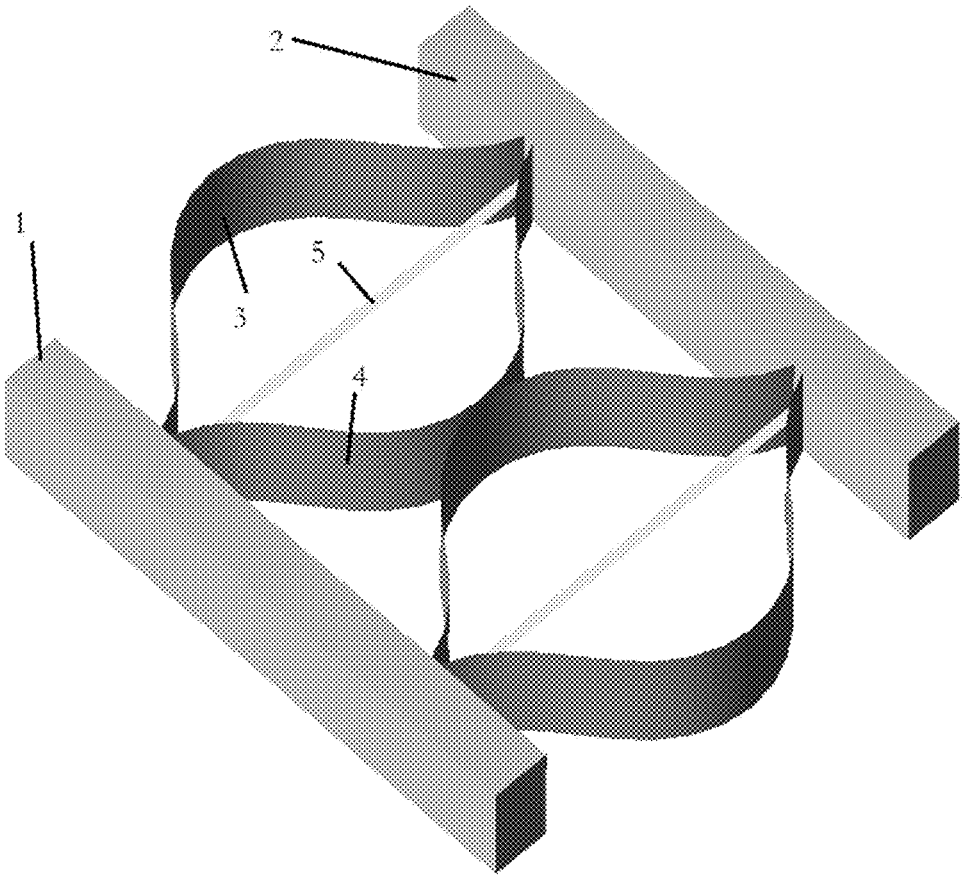
FIG. 1 is a structural diagram showing a clamping apparatus as provided in an embodiment of the present invention.

In the drawings: 1 first connecting piece; 2 second connecting piece; 3 first slice; 4 second slice; and 5 rope.

EMBODIMENTS

To make purposes, technical solutions and advantages of the present invention more clear and apparent, hereinafter a detailed description will be given to the present invention based on the drawings and the embodiments. It shall be understood that, the specific embodiments are only used to explain the present invention rather than limit the present invention.

It shall be comprehensible that, terms "first", "second" etc. in the present invention can be used to describe a variety of components, unless explained specifically, the components are not restricted by the terms. The terms are only intended to differentiate one component from another component. For example, without departing from the scope of the present invention, the first xx script can be called the second xx script, and similarly, the second xx script can be called the first xx script.

As shown in FIG. 1, in an embodiment, the present invention provides a constant load clamping apparatus of injector head of coiled tubing drilling machine, wherein the apparatus comprises:

At least one ropeslice-rope structure, wherein a first connecting piece 1 and a second connecting piece 2 are connected at both ends of the at least one ropeslice-rope structure;

A first slice 3 and a second slice 4 are symmetrically provided in the at least one ropeslice-rope structure, the first slice 3 and the second slice 4 are provided in parallel, a piece of rope 5 is provided in between the first slice 3 and the second slice 4, one end of the first slice 3, one end of the second slice 4 and one end of the rope 5 are fixed at a first fixing position of the first connecting piece 1, and another end of the first slice 3, another end of the second slice 4 and another end of the rope 5 are fixed at a second fixing position of the second connecting piece 2.

Figure 2:
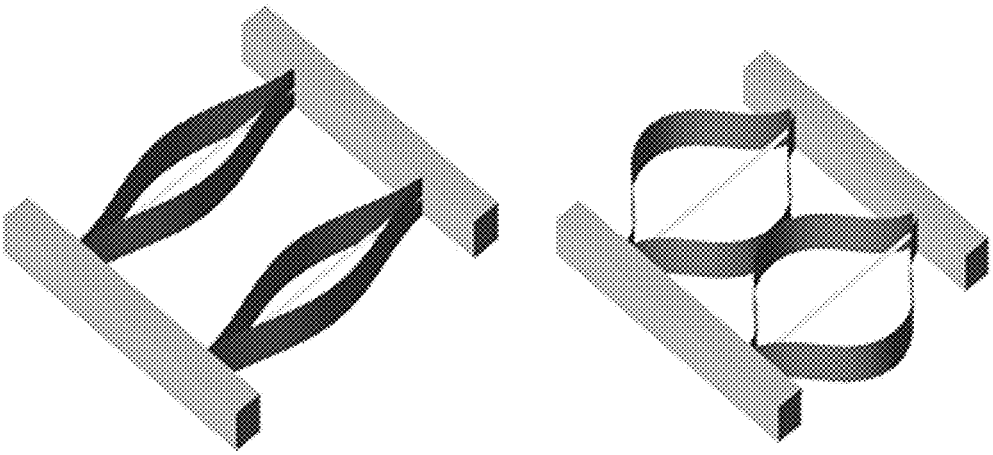
FIG. 2 is a diagram showing an initial state and a deformed state of the clamping apparatus as provided in an embodiment of the present invention.

In the present embodiment, for the at least one ropeslice-rope structure as shown in FIGS. 1 and 2, straight slices that are curved initially are provided at an upper position and a lower position of the at least one ropeslice-rope structure, in an intermediate portion thereof, a rope is used to connect both ends of the at least one ropeslice-rope structure to exert initial stress to maintain the slices of the at least one ropeslice-rope structure curved. Exert axial displacement on one end of the at least one ropeslice-rope structure for driving, so that the one end of the at least one ropeslice-rope structure moves towards another end of the at least one ropeslice-rope structure, during this process, as the slices at both sides of the at least one ropeslice-rope structure are curved, and the rope in the intermediate portion cannot bear pressure, the driving force can be basically maintained unchanged, so that constant load clamping can be realized and the entire structure has a low rigid stiffness. Furthermore, to provide the structure with higher static loading capacities to satisfy requirements of extreme working conditions and high injection forces and pullout forces of injector heads, two sets of the ropeslice-rope structures are installed in parallel. As shown in FIG. 2, when deformation of the slices in the intermediate portion reaches a certain degree, they will contact and axial supporting forces are further enhanced.

Figure 3:
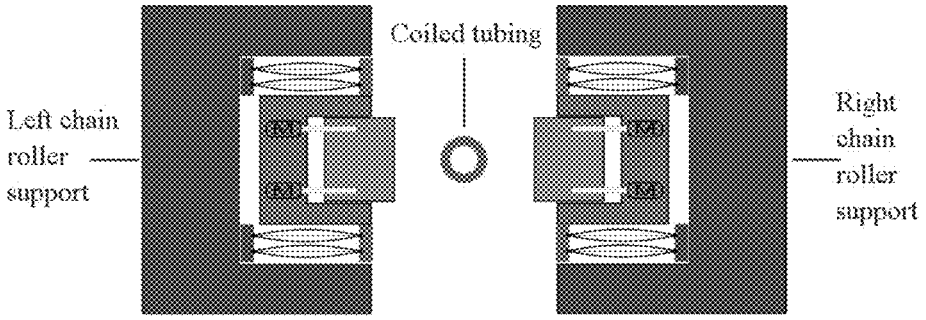
FIG. 3 is an installation diagram showing the clamping apparatus on a chain rolling system as provided in an embodiment of the present invention.

Working procedures of the clamping apparatus are divided into three stages, before deformation, the rope provides the initial stress, so that the slices are flexed; during deformation, the slices continue to deform driven by axial displacement, at this time, axial rigidity of the entire structure remains almost unchanged, that is, rigid stiffness is almost 0, constant load clamping is realized finally, the two slices in the intermediate portion continue to deform and contact each other, the axial rigidity of the clamping apparatus is increased, higher static rigidity is provided and for the entire device, the higher positions are static and the lower positions are dynamic. Fix one end of the ropeslice-rope structures to the rack of the injector head, another end thereof to the pedestal of the injector head, the entire structures can work, two clamping apparatuses are installed on each side of the rack, totally four clamping apparatuses, as shown in FIG. 3.

Figure 4:
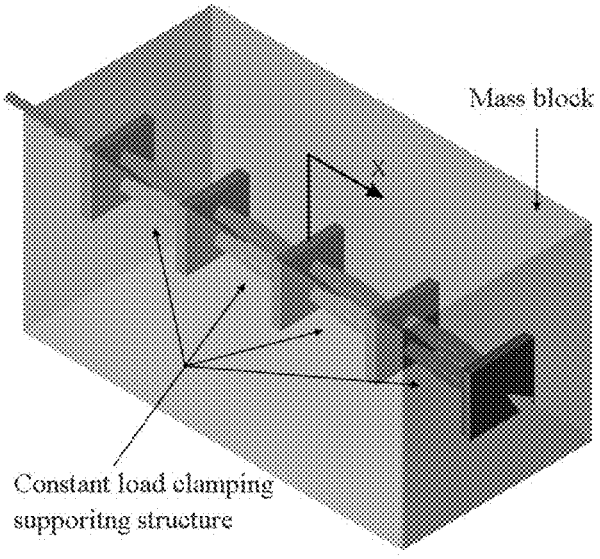
FIG. 4 is a diagram showing a simplified constant load holding and vibration damping performance test model of the clamping apparatus as provided in an embodiment of the present invention.

In the present embodiment, a simplified model is built for the foregoing constant load clamping apparatus and at least one mass block, as shown in FIG. 4, the simplified model comprises four clamping apparatuses and a mass block. Among them, the mass block is configured to simulate the total weight of the drilling machine. The two clamping apparatuses at both sides are configured to simulate the chain roller system clamping apparatuses installed in parallel in two layers respectively. With the foregoing simplified model dynamic temporal domain simulation is done to verify the constant load clamping and vibration damping performance of the clamping apparatus designed in the present invention.

As per an installation method of 16 clamping apparatuses in an upper row and a lower row respectively, a mass of the mass block is selected to be 1/32 of the total weight of the drilling machine 11500 kg. First of all, a 4 mm displacement is exerted by the mass block via the connecting pieces at the outermost to the center to simulate the clamping process of the chain roller system. Subsequently, a certain displacement X is exerted on the connecting pieces in the intermediate portions, to simulate transverse movement of the coiled tubing in the intermediate portions so as to verify constant load clamping and vibration damping performance respectively. Connect the mass block with the ground, exert a quasi-static displacement of ±4 mm to the connecting pieces at the intermediate portions as per the STEP function as following, wherein an average movement speed is 0.4 mm/s.

$$\text{step}(\text{time}, t_0, x_0, t_1, x_1) = \begin{cases} x_0, & \text{time} \le t_0 \\ x_0 + \left(\dfrac{\text{time} - t_0}{t_1 - t_0}\right) \cdot (x_1 - x_0), & t_0 < \text{time} \le t_1 \\ x_1, & \text{time} \ge t_1 \end{cases}$$

Figure 5:
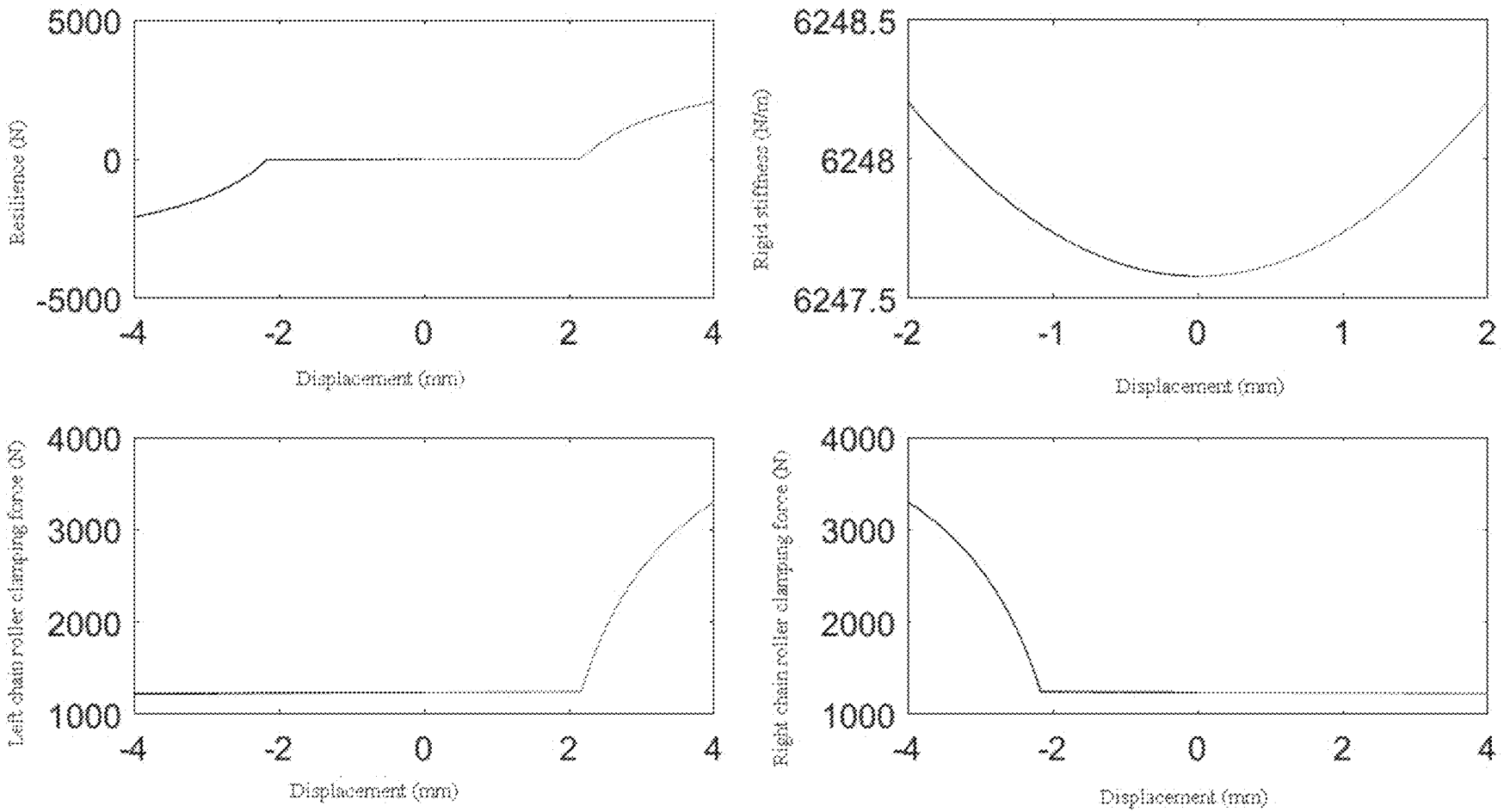
FIG. 5 is a diagram showing relationships among resilience, dynamic stiffness, unilateral gripping forces and displacement during clamping of the clamping apparatus as provided in an embodiment of the present invention.

Results of resilience and rigid stiffness for the constant force clamping of the clamping apparatus are shown in FIG. 5, when both sides enter a clamping state, the resilience of the clamping apparatus at a balanced position is basically 0, and the rigid stiffness is small, the chain roller clamping force at both sides is maintained close to 1.24 kN; when going beyond the working interval [−2 m, 2 m], the resilience is abruptly increased, the single side chain roller clamping force is correspondingly increased rapidly, and a static bearing force nearly 3 times of the bearing force at the balanced position is provided. And the foregoing indicators agree with the design targets of constant force clamping and static higher positions and dynamic lower positions and vibration damping.

Figure 6:
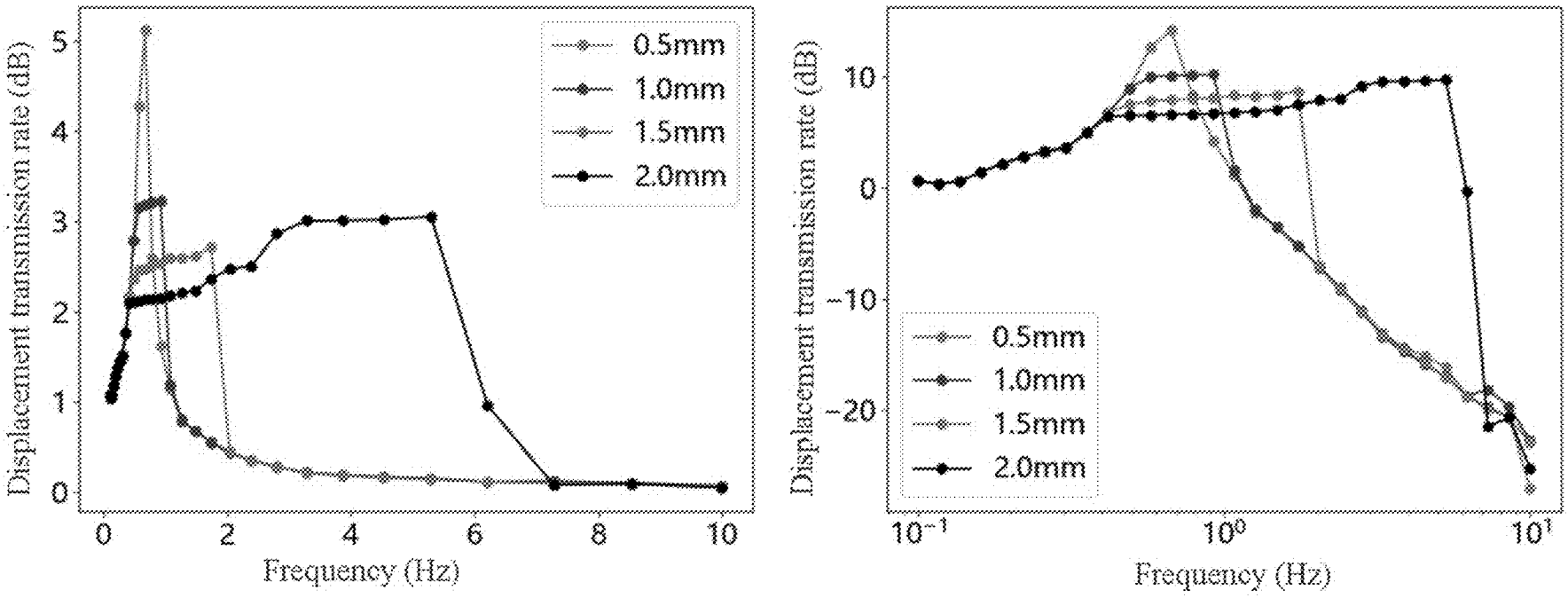
FIG. 6 is a curve diagram showing frequency response of the clamping apparatus connected in series with another clamping apparatus as provided in an embodiment of the present invention.

Connect the mass block with the ground via at least one sliding pair, exert simple harmonic quantity vibration with a frequency of 0.1 Hz-10 Hz and a magnitude of 0.5 mm to 2.0 mm to the intermediate connecting pieces to simulate transverse vibration of the coiled tubing clamped when the drilling machine is working, conduct vibration damping performance tests on the clamping apparatuses and obtain results of the frequency response curves as shown in FIG. 6.

Displacement transmission rate increases along with the magnitude, vibration damping frequency of the system increases, the frequency response curves curve to the right, and this illustrates that, the structures are non-linear systems with harder and harder rigidities, during design, it is necessary to consider influence of the vibration magnitude on vibration damping performance. When excited vibration amplitude is smaller than 1 mm, the system has good vibration damping effects for vibration with frequencies higher than 1.2 Hz, and when the excited vibration amplitude exceeds 2 Hz, the vibration damping efficiency will go beyond 50%.

Figure 7:
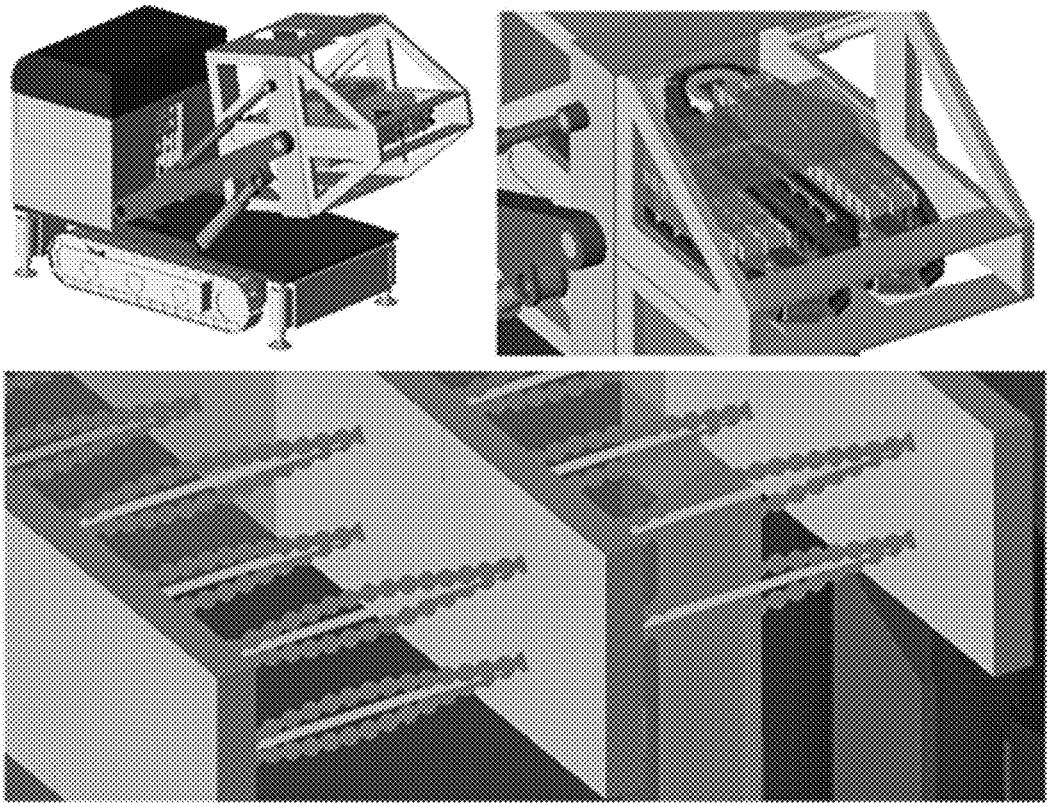
FIG. 7 is a diagram showing an installation position of the clamping apparatus in the coiled tubing drilling machine according to an embodiment of the present invention.

In an embodiment, the constant load clamping apparatus is designed to be two layers of apparatuses connected in parallel and 16 sets of apparatuses connected in series. The structure is then installed on the chain roller system of the drilling machine to conduct full-model drilling and vibration temporal domain simulation. The full model of the coiled tubing drilling machine for horizontal drilling is shown in FIG. 7.

Figure 8:
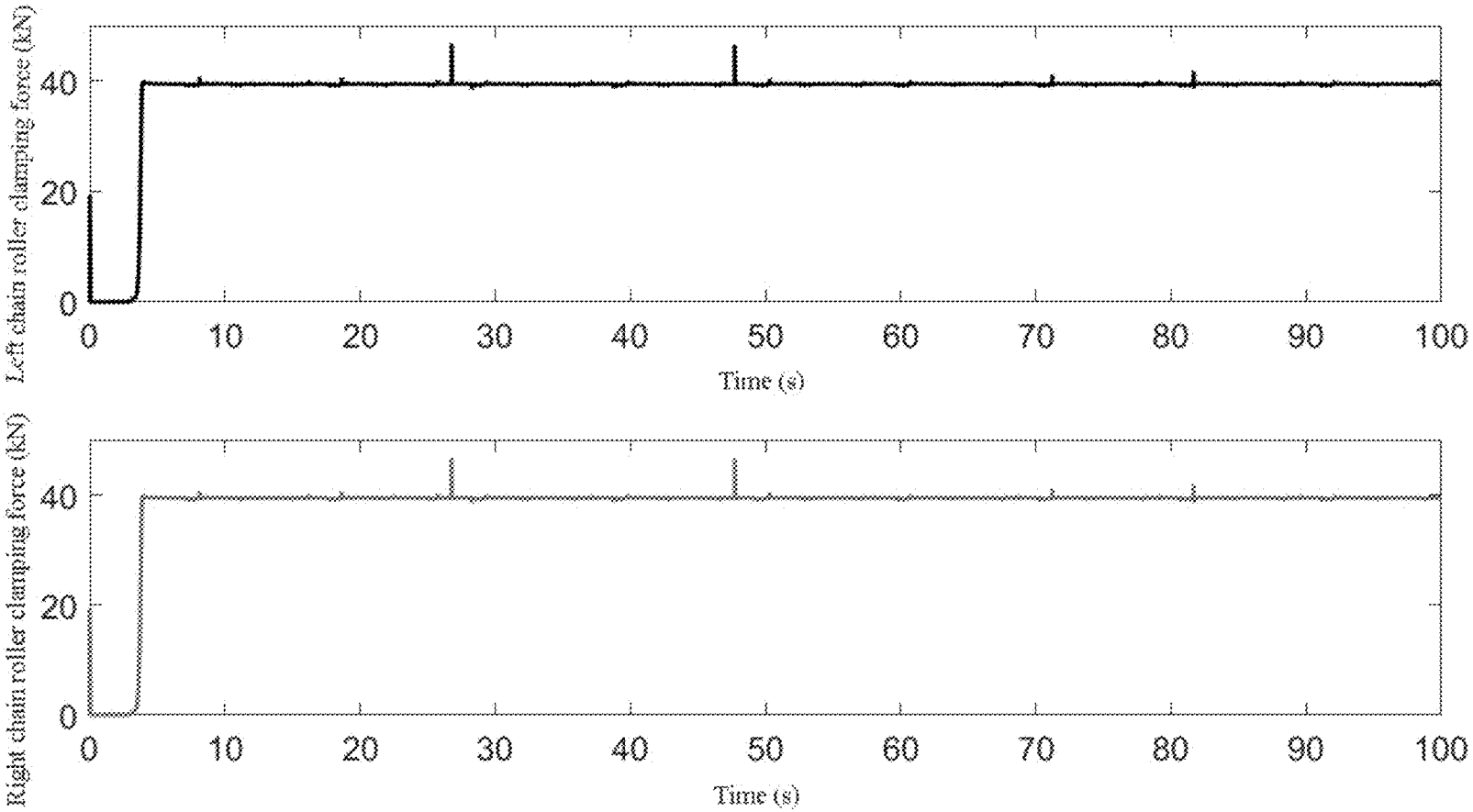
FIG. 8 is a curve diagram showing clamping forces of the chain rolling system at both sides of the clamping apparatus according to an embodiment of the present invention.

Select an outer diameter of the coiled tubing at the intermediate portion to be 2⅞ inches, a diameter of a borehole to be 4 inches, parameters of measuring points of a track has a 10° inclination at 0 m, 10° inclination at 100 m, set a displacement of the intermediate extrusion plate to be 23 mm, so that the chain holding block will clasp the intermediate coiled tubing, in 5 s, the rotation rate of the drive wheel will be increased to 0.1 rad/s, the chain will drive the coiled tubing to drill forward, during this process, the clamping forces offered by the chain roller systems at both sides are as shown in FIG. 8, after entering clamping work conditions, the clamping forces of the chain roller systems at both sides are maintained at 40 kN for both sides. It can be seen that the present clamping apparatus can satisfy requirements of constant load during drilling.

Figure 9:
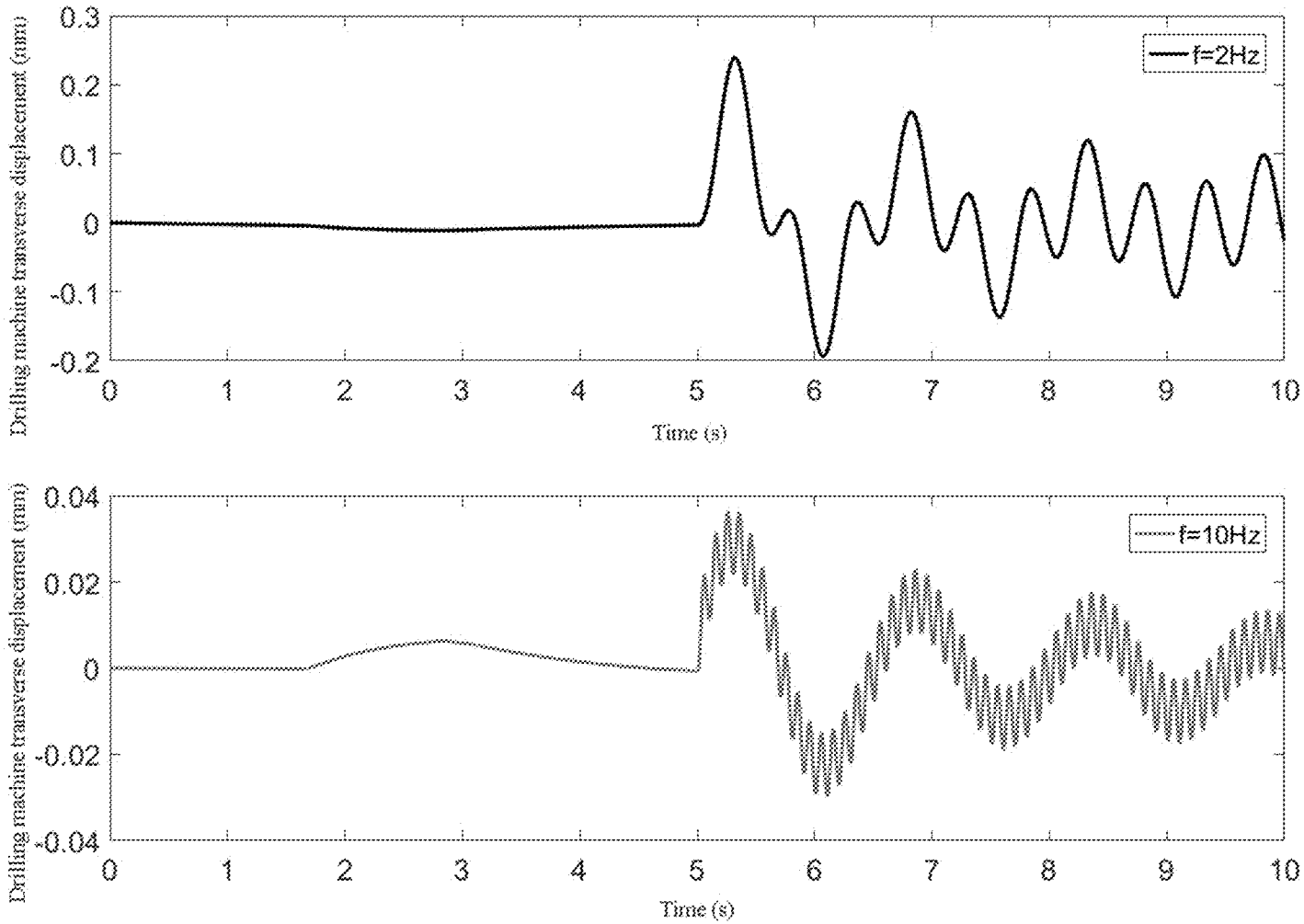
FIG. 9 is a curve diagram in a temporal domain when the drilling machine displaces transversely according to an embodiment of the present invention.

Subsequently, connect the drilling machine with the ground via at least one sliding pair, at the first 5 s, move the extrusion plates at both sides of the chain roller systems 23 mm towards the intermediate portion, after clamping the coiled tubing, exert a simple harmonic quantity vibration with a frequency of 10 Hz and an amplitude of 0.5 mm to the intermediate coiled tubing to simulate the working conditions of transverse vibration of the coiled tubing clamped in the intermediate portion when the drilling machine is working, and obtain the temporal domain curves of transverse displacement of the drilling machine as shown in FIG. 9. In a working condition with an externally excited frequency of 2 Hz, an amplitude of transverse displacement of the drilling machine goes less than 0.2 mm, compared with the amplitude with an externally excited frequency of 0.5 mm the amplitude is in a quite low level, the vibration damping efficiency is more than 50%; when the externally excited frequency is improved to 10 Hz, the amplitude is maintained under 0.04 mm, and has a tendency to continue reducing, the displacement transmission rate is smaller than 0.1, that is, the vibration damping efficiency is over 90%. In summary, the present clamping apparatus has a good insulation effect for vibration excitation with a frequency of over 2 Hz, and amplitude less than 0.5 mm.

Figure 10:
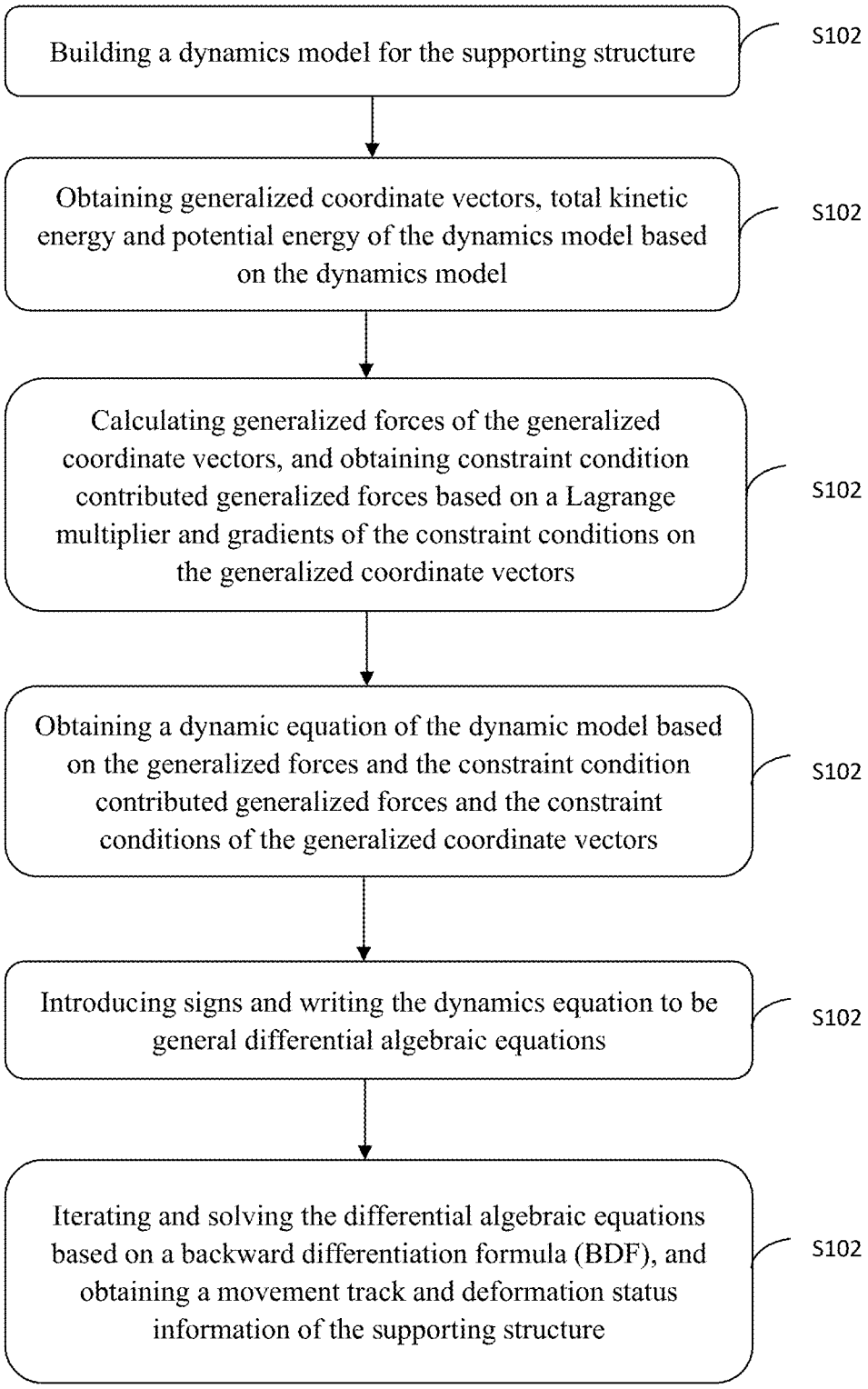
FIG. 10 is a calculation flowchart diagram showing a dynamic design method of the clamping device according to an embodiment of the present invention.
Figure 11:
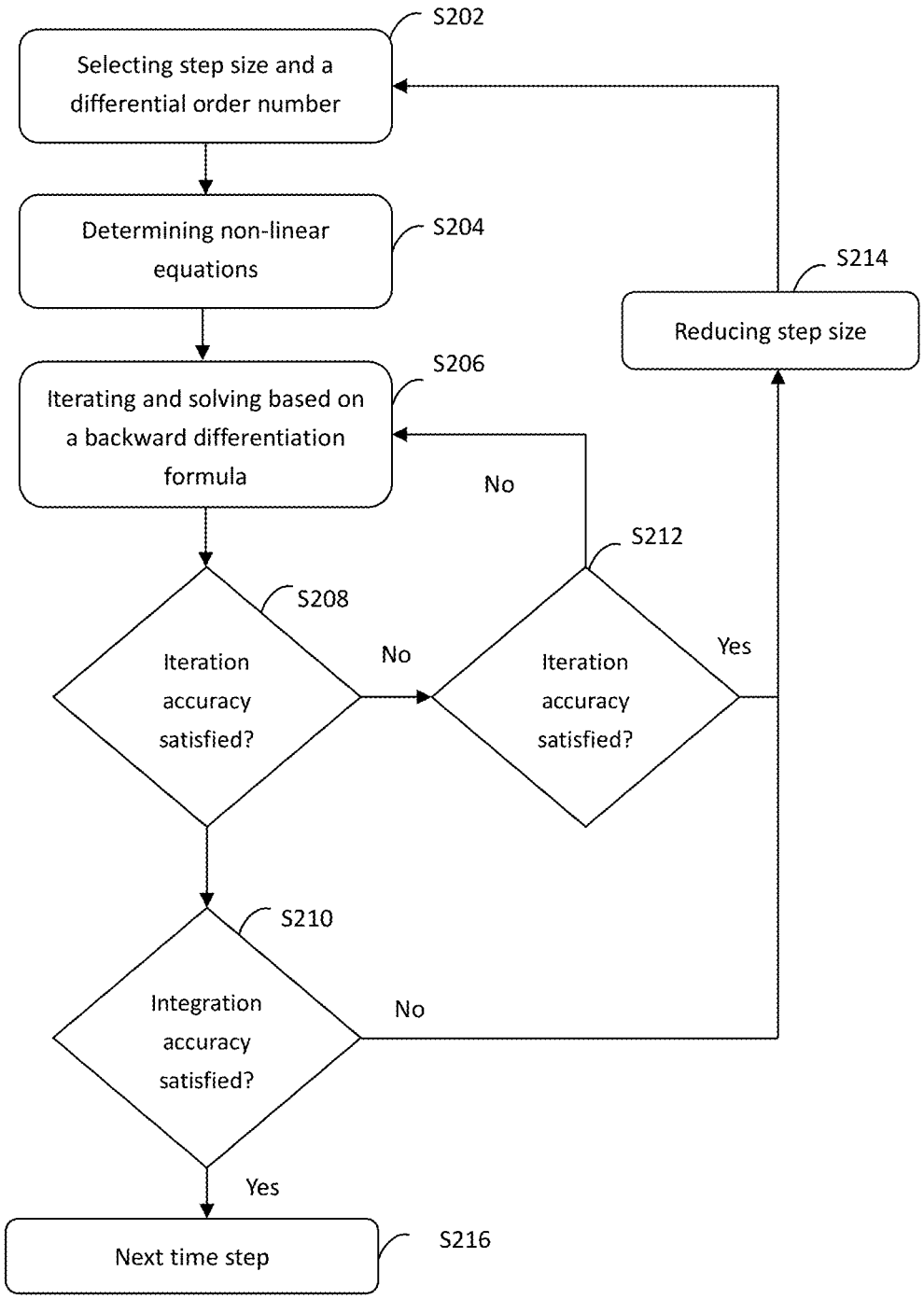
FIG. 11 is a diagram showing solving differential algebraic equations of the dynamic design method of the clamping apparatus as provided in an embodiment of the present invention.

As shown in FIG. 10, in an embodiment, the present invention proposes a design method of constant load clamping apparatus of injector head of coiled tubing drilling machine, wherein the design method comprises the following steps:

Step S102, building a dynamics model for the clamping apparatus;

Step S104, obtaining generalized coordinate vectors of the dynamics model and total kinetic energy and total potential energy based on the dynamics model;

Step S106, calculating generalized forces of the generalized coordinate vectors, and obtaining constraint condition contributed generalized forces by Lagrange multiplier and gradients of constraint conditions on the generalized coordinate vectors;

Step S108, obtaining dynamics equations of the dynamics model based on the generalized forces, the constraint condition contributed generalized forces, and the constraint conditions of the generalized coordinate vectors;

Step S110, introducing signs, and writing the dynamics equations to be general differential algebraic equations;

Step S112, iterating and solving the differential algebraic equations according to a backward difference method, and obtaining a movement track and deformation status information of the clamping apparatus.

In the present embodiment, when conducting dynamic analysis, generally, the dynamics model is divided into a plurality of small units, analyzing bearing conditions of each of the plurality of small units, listing all generalized coordinates of each of the plurality of small units of the dynamics model together and forming the generalized coordinate vectors of the dynamics model:

$$q=[q_1, q_2 \ldots q_k]^T$$

Listing all constraints that the generalized coordinate vectors of the dynamics model subjects to:

$$C_\alpha(q,t)=0, \alpha=1, \ldots, m$$

Adding kinetic energy and potential energy of all the units in the dynamics model and obtaining the total kinetic energy T and potential energy U, calculating the generalized forces $Q_j^e$, thereafter, obtaining the constraint condition contributed generalized forces according to the Lagrange multiplier $\lambda_\alpha$ and the gradients of the constraint conditions on the generalized coordinates $$\frac{\partial C_\alpha}{\partial q_j},$$

and finally obtaining the first class Lagrange equations of the dynamics model:

$$\begin{cases} \frac{d}{dt}\frac{\partial T}{\partial \dot{q}_j} - \frac{\partial T}{\partial q_j} + \frac{\partial U}{\partial q_j} + \sum_{\alpha=1}^{m} \lambda_\alpha \frac{\partial C_\alpha}{\partial q_j} - Q_j^e = 0, & j = 1, \ldots, k \\ C_\alpha(q, t) = 0, & \alpha = 1, \ldots, m \end{cases}$$

The dynamics equations of the dynamics model can be further expressed in the following manner of a matrix:

$$\begin{cases} M\ddot{q} + C_q^T\lambda - Q(\dot{q}, q, t) = 0 \\ C(q, t) = 0 \end{cases}$$

Introducing signs $y=(q^T, \lambda^T)^T$, $\lambda=(\lambda_1, \ldots, \lambda_m)^T$, writing the foregoing equation to be a more generalized form:

$$F(y,\dot{y},\ddot{y},t)=0$$

In the equation, $\dot{y}$ and $\ddot{y}$ are a first-order derivation and a second-order derivation with respect to time.

These are typical time-varying non-linear differential algebraic equations, the backward differentiation formula can be used to solve the equations, and obtain the transient time interval response of the dynamics model of the clamping apparatus during large-scale motions, and obtain the movement track and the deformation status information.

In the present embodiment, the flow process for solving the numerical integration of the differential algebraic equations is:

Step S202, selecting a step size and a differential order number;

Step S204, determining non-linear equations;

Step S206, iterating and solving according to the backward differentiation formula; and Step S208, judging whether iteration accuracy satisfies predetermined values;

When the iteration accuracy satisfies the predetermined values, step S210, judging whether differentiation accuracy satisfied predetermined values;

When the iteration accuracy does not satisfy the predetermined values, step S212, judging whether the maximum iteration number is reached;

When the maximum iteration number is reached, step S214, reducing the step size and returning to the step S202, when the maximum iteration number is not reached, returning to the step S206;

When integration accuracy satisfies a predetermined value, going to step S216 for the next time step, when the integration accuracy does not satisfy the predetermined value, executing the step S214 to reduce the step size and returning to the step S202.

In an embodiment, the clamping apparatus comprises at least one ropeslice-rope structure, a plurality of ropeslice-rope structures can be provided, strip-shaped connecting pieces can be connected at both ends of the ropeslice-rope structures respectively, to promise that each of the plurality of ropeslice-rope structure will move synchronously and axially, a model is built for the slices with a Lagrange beam unit, wherein a cross section of the slices are designed to be a rectangle; a model is built for the ropes with a Lagrange rope unit, the ropes are bear only tensional loads; a model is built for the strip-shaped parts at both ends with a rigid body, that is, it is assumed that the deformation occurs only in between the slices in the intermediate portion and the ropes.

Figure 12:
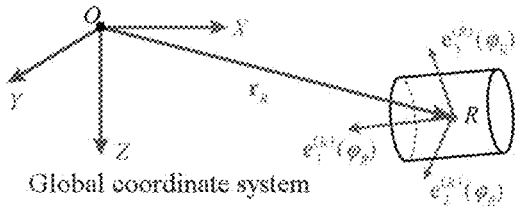
FIG. 12 is a diagram showing rigid body units of the dynamic design method of the clamping apparatus as provided in an embodiment of the present invention.

In an embodiment, as shown in FIG. 12, a model is built for the strip-shaped connecting pieces at both ends of the clamping apparatus in the dynamics model with a rigid body, generalized coordinates $q_R=[r_R^T\ \varphi_R^T]^T$ are selected, wherein $r_R$ stands for a position of a mass center of the rigid body, $\varphi_R$ stands for a gesture of the rigid body, wherein the generalized velocity and acceleration can be represented as:

$$\dot{q}_R=[\dot{r}_R^T\ \dot{\varphi}_R^T]^T,\ \ddot{q}_R=[\ddot{r}_R^T\ \ddot{\varphi}_R^T]^T$$

The angular velocity and angular acceleration of a rigid body in a local coordinate system can be expressed as:

$$\bar{\omega}_R=H^T\dot{\varphi}_R,\ \dot{\bar{\omega}}_R=H^T\ddot{\varphi}_R+\dot{H}^T\dot{\varphi}_R$$

In the equation, H is a transfer matrix, for any rotation vector $$\varphi = [\varphi_1\ \ \varphi_2\ \ \varphi_3]^T$$

$$H(\phi) = I + \frac{1-\cos\varphi}{\varphi^2}\tilde{\phi} + \frac{\varphi-\sin\varphi}{\varphi^3}\tilde{\varphi}\tilde{\varphi}$$

In the equation $\varphi=\|\varphi\|$, $\tilde{\varphi}$ is an antisymmetric matrix corresponding to $\varphi$. The generalized inertia force of the rigid body can be expressed as:

$$Q_{iner}^R = \begin{bmatrix} Q_t^R \\ Q_r^R \end{bmatrix} = -\begin{bmatrix} m\ddot{r}_R \\ H\left[J_R\dot{\bar{\omega}}_R + \bar{\omega}_R \times (J_R\bar{\omega}_R)\right] \end{bmatrix}$$

In the equation $J_R=\mathrm{diag}(J_{Rx} J_{Ry}\ J_{Rz})$ is a principal moment of inertia tensor of the rigid body in the local coordinate system.

To summarize, a rigid body dynamic equation is obtained:

$$Q_{iner}^R+Q_{ext}^R+Q_{cons}^R=0$$

In the equation $Q_{ext}^R$ and $Q_{cons}^R$ are generalized external forces and generalized constraint forces that the rigid body is subjected to.

Figure 13:
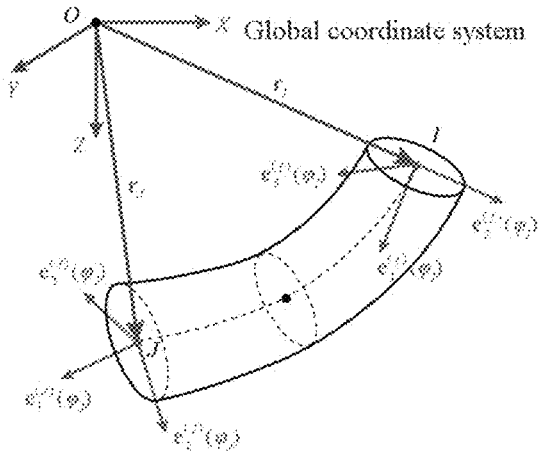
FIG. 13 is a diagram showing a two-node lagrange beam unit of the dynamic design method of the clamping apparatus according to an embodiment of the present invention.

In an embodiment, as shown in FIG. 13, a model of the slice in the clamping apparatus dynamics model is built based on the Timoshenko beam unit based on the Lagrange method, wherein the generalized coordinates are selected to be:

$$q_B=[q_I^T q_J^T]^T=[r_I^T \varphi_I^T r_J^T \varphi_J^T]^T$$

The generalized inertia force of the beam unit can be expressed as:

$$Q_{iner}^B=-\rho AL\left[\int_0^1 N_r^T N_r d\xi\right]\ddot{q}_B-\rho L\int_0^1\left\{N_\varphi^T H[J\ddot{\varphi}_B+\overline{\omega}_B\times(J\overline{\omega})_B]\right\}d\xi$$

Wherein ρ, A, L represent density, cross section and length of the beam respectively, $N_r$, and $N_\varphi$, represent shape functions of moveable coordinates and rotation coordinates respectively. The generalized elastic force of the beam unit can be expressed as:

$$Q_{elas}^B=-L\int_0^1\left[\left(\frac{\pi}{\partial q_B}\right)^T\Gamma+\left(\frac{\partial\overline{\kappa}}{\partial q_B}\right)^T\overline{M}\right]d\xi$$

Wherein $\overline{\gamma}$ and $\Gamma$ are a stress vector and a unit stress corresponding to the stress vector on the beam unit respectively, $\overline{\kappa}$ and $\overline{M}$ are a bending vector of the beam unit and a unit stress corresponding to the bending vector respectively.

In summary, the dynamic equation of the beam unit is:

$$Q_{iner}{}^B+Q_{elas}{}^B+Q_{ext}{}^B+Q_{cons}{}^B=0$$

In the equation, $Q_{ext}{}^B$ and $Q_{cons}{}^B$ are the generalized external force and the generalized constraint force that the beam unit is subjected to.

Figure 14:
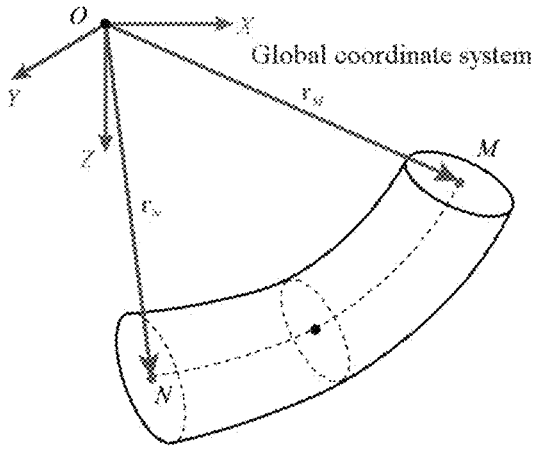
FIG. 14 is a diagram showing a two-node lagrange rope unit of the dynamic design method of the clamping apparatus according to an embodiment of the present invention.

In an embodiment, as shown in FIG. 14, a model of the rope in the clamping apparatus dynamics model is built based on a large deformation flexible cable element of the Lagrange method, the spatial three dimensional flexible cables will make movement in three directions only, therefore, by determining positions of nodes at both ends of the cable element, the configuration of the cable is determined, and the generalized coordinates of the cable are selected to be:

$$q_C=[q_M{}^T q_N{}^T]^T=[r_M{}^T r_N{}^T]$$

The generalized inertia forces of the cable element can be expressed as:

$$Q_{iner}^C=-\rho AL\left[\int_0^1 N_r^T N_r d\xi\right]R\ddot{q}_C$$

Wherein ρ, A, L are the density, cross section area and length of the cable respectively $N_r$ is a shape function of the movement coordinates. The generalized elastic force of the cable element can be expressed as:

$$Q_{elas}^C=-L\int_0^1\left[\left(\frac{\partial\varepsilon}{\partial q_C}\right)^T EAk\varepsilon\right]d\xi$$

Wherein ε is a tension strain of the cable element, E and A are Young's modulus and cross sectional area of the cable respectively, and k is a coefficient of the tensile stress of the cable, that is:

$$k=\begin{cases}1 & \varepsilon\geq 0\\ 0 & \varepsilon<0\end{cases}$$

From the foregoing equations, the dynamic function of the cable element can be obtained:

$$Q_{iner}{}^C+Q_{elas}{}^C+Q_{ext}{}^C+Q_{cons}{}^C=0$$

In the equation, $Q_{ext}{}^C$ and $Q_{cons}{}^C$ are generalized external forces and generalized constraints that the cable element-cable element is subjected to.

In an embodiment, the design parameters in the clamping apparatus dynamics model comprise: span length, span height, width, thickness of the slice, and amount of the slices; the length, diameter of the cable; and distance in between the strip shaped connecting pieces and the height and the width of the strip shaped connecting pieces.

In the present embodiment, the span length of the slices is a fixed value, and variable design parameters comprise: the width, thickness of the slices and the installation distance between two sets of slice-cable structures, and an object function is designed as following:

wherein $a_{load}$ and $a_{disp}$ represent weights of average working load and working interval length respectively; $f_{load}(w,h,d)$, $f_{disp}(w,h,d)$ and $f_{disp}(w,h,d)$ represent functions of relations among the average work load, working interval length and slice width w, slice thickness h and installation distance d, and all of them are obtained by dynamics simulation calculation respectively; $T_{load}$, $T_{disp}$ and $T_{sigma}$ are objective values of the average working load, the working interval length and the maximum positive stress of the slice respectively.

Figure 15:
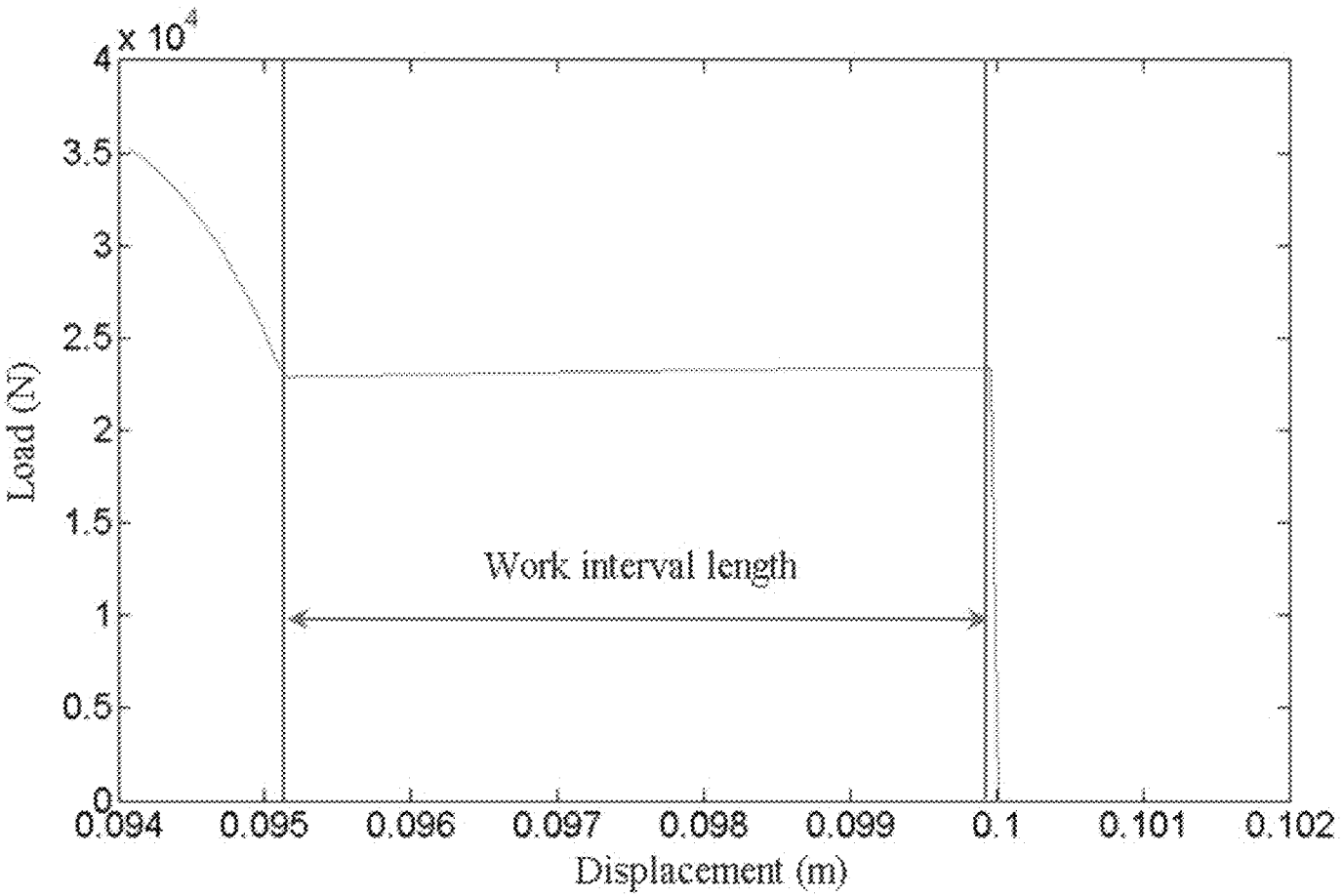
FIG. 15 is a curve diagram showing load-displacement of the clamping apparatus with certain design parameters of the dynamic design method of the clamping device as provided in an embodiment of the present invention.

In the foregoing equations, a constraint is also given to the variation of the independent variable, therefore, the problem belongs to the simple bounds optimization, and the foregoing object function is optimized by trust region constraint algorithms, and both Jacobi matrix and Hessen matrix are calculated by the Broyden-Fletcher-Goldfarb-Shanno (BFGS) algorithm. As shown in FIG. 15, take as an example the load-displacement curve of a certain calculation result, the working interval length is a length of a region that changes gently, and the average working load is an average value of loads in the interval. In the present invention, by connecting two apparatuses in series, a bigger total working interval length can be provided on the basis that the slices bear smaller positive stress. Finally, to ease repair and replacement, the device is divided into 16 sets and then connected in parallel.

Figure 16:
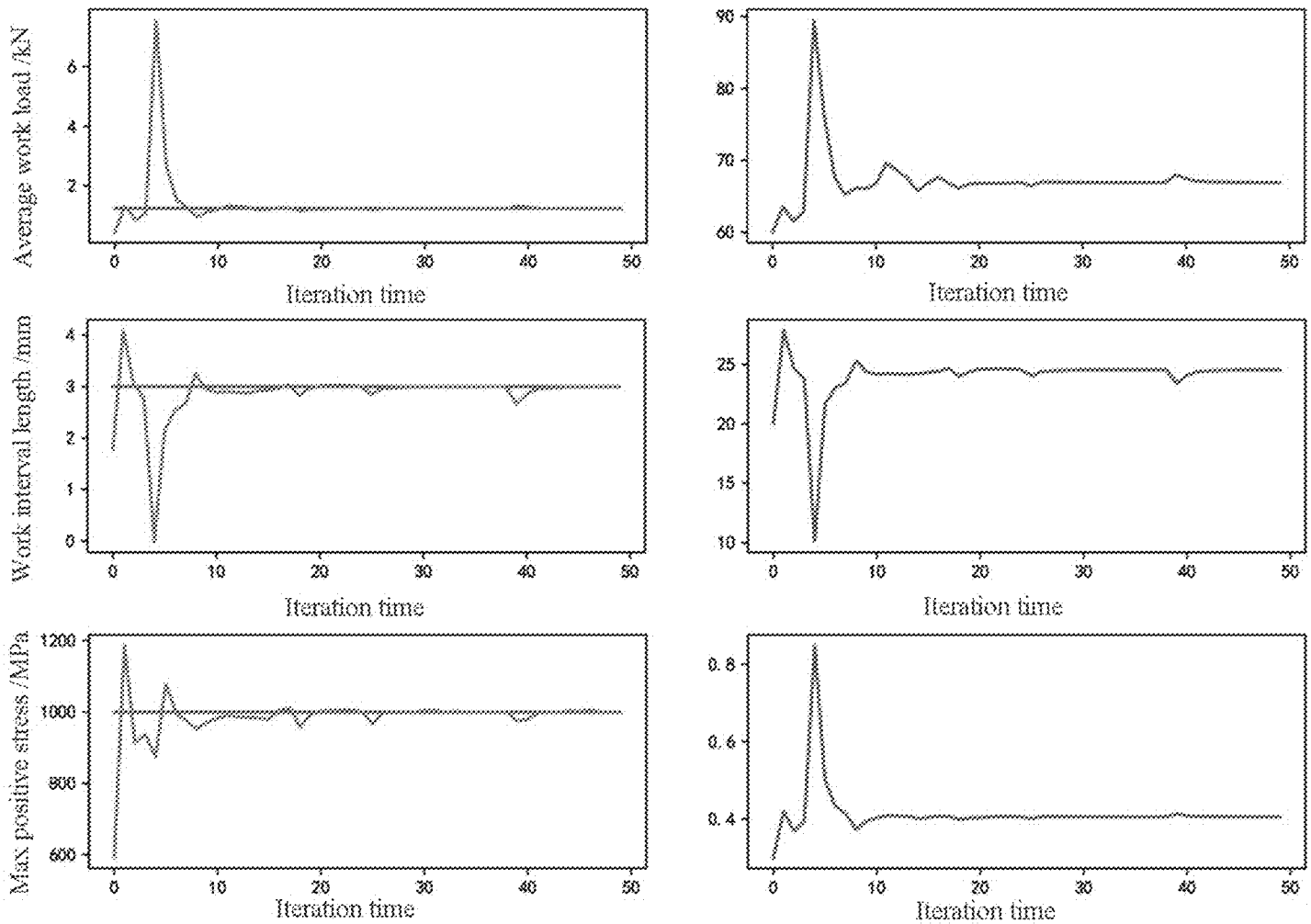
FIG. 16 is a diagram showing an optimization process of average work load, working interval lengths and maximum normal stress according to the dynamic design method of the clamping apparatus as provided in an embodiment of the present invention.

In the present embodiment, exemplarily, set the object of the average working load of a single set of slice-cable structure to be 1250 N, the object of the working interval length 0.003 mm, and the object of the maximum positive stress 1000 MPa, the initial design parameters are:

The slice span length 0.1 m, the slice span height 0.005 m, the slice width [0.01 m, 0.11 m], the slice thickness [0.0001 m, 0.0023 m], the amount of the slices 20, the length of the cable 0.1 m, the diameter of the cable 0.002 m, an installation distance between two sets of "slice-cable" structures is [0.025 m, 0.135 m], the height of the connecting piece (in a direction of x) is 2.5 times of the installation distance, and the width of the connecting piece (in a direction of z) is [0.01 m, 0.11 m].

Wherein both the slices and the cables are made of the same material, with a density of 7850.89 kg/m$^3$, the elastic modulus is 206.84 GPa, and the Poisson ratio is 0.3. Take the weight parameters to be reciprocal values of object values in the same unit system, that is, $$a_{load} = \frac{1}{1250},$$

$$a_{disp} = \frac{1}{0.003},$$

$$a_{sigma} = \frac{1}{10^{10}}$$

and the optimization process is shown in FIG. 16.

Figure 17:
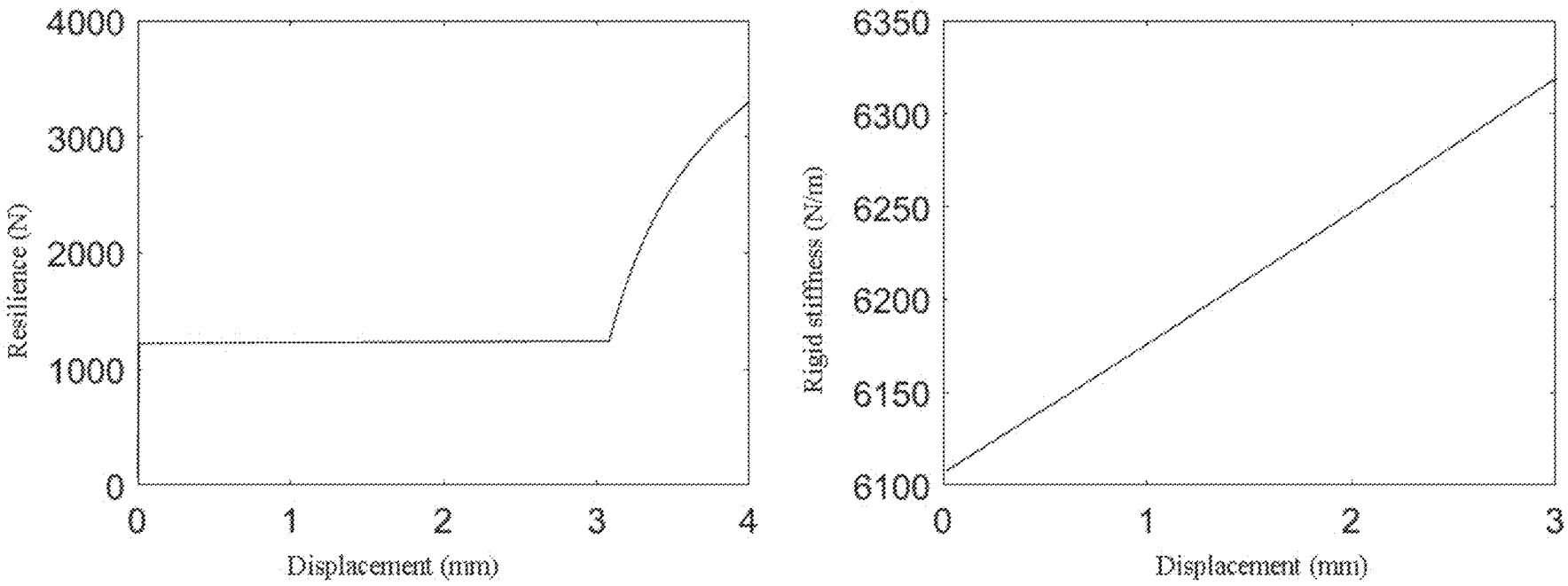
FIG. 17 is a diagram showing relationships between resilience, rigid stiffness and displacement of the clamping apparatus after optimization of the dynamic design method of the clamping apparatus as provided in an embodiment of the present invention.

During optimization, totally 50 iterations and 200 dynamics simulation calculations have been executed, and the blue lines in the diagram on the left show the corresponding objective values. As shown in FIG. 16, after iteration for 30 times, the average work load and the work interval length are close to the objective value 1.25 kN, 0.003 mm and 1000 MPa, and during iterations, the optimum slice width is 66.93 mm, the optimum installation distance is 24.54 mm, and the optimum slice thickness is 0.4056 mm, the resilience-displacement curve of the clamping apparatus after optimization and the rigidity-displacement curve in the working interval are shown in FIG. 17, wherein the dynamic stiffness K is obtained by differentiating the displacement x with the disperse resilience $$F: K_i = \frac{F_{i+1} - F_i}{x_{i+1} - x_i},$$

From FIG. 17, it can be known that, the clamping apparatus has a basically constant resilience in a displacement interval of 0-3 mm, define the area enclosed by the resilience and the displacement from the starting point to the end point of the working interval divided by the length of the working interval to be the average resilience, the average resilience of the clamping apparatus is 1.24 kN. When the displacement is more than 3 mm, the resilience of the entire structure increases abruptly, and a higher clamping force can be provided by the higher static bearing capacity.

It shall be understood that, although the steps in the flow chart diagrams of the embodiments are shown sequentially as per indication of arrows, the steps are not necessarily sequentially executed as per the sequence indicated by the arrows. Unless explicitly explained in the present description, there is no strict limitation on the sequence of execution of the steps, and the steps can be executed in sequences other than those disclosed herein. Furthermore, at least some of the steps can include a plurality of sub-steps or a plurality of stages, and the plurality of sub-steps or the plurality of stages are not necessarily executed at the same moment, and can be executed at different moments, the execution sequence of the plurality of sub-steps or the plurality of stages are not necessarily limited, and they can be executed alternately or in turn with other steps or sub-steps or stages of other steps.

Those of ordinary skill in the art shall understand that all or some flow processes in the method embodiments can be completed by having a computer program instructing corresponding hardware, the computer program can be stored in a non-volatile readable storage medium, and the program when executed, can include the flow processes as per the foregoing method embodiments. In the present invention, any citation to storage device, memory, database or other medium in the embodiments includes both non-volatile and/or volatile memory. Non-volatile storage memory can included read-only memory (ROM), programmable ROM (PROM), electronic programmable ROM (EPROM), electronic erasable programmable ROM (EEPROM) or flash memory. Volatile storage memory can include random access memory (RAM) or external high speed cache memory. Explanatorily rather than restrictively, the RAM can be obtained in a plurality of forms, for example, static RAM (SRAM), dynamic RAM (DRAM), synchronous DRAM (SDRAM), double data rate SDRAM (DDRS-DRAM), enhanced SDRAM (ESDRAM), synchlink DRAM (SLDRAM), Rambus direct RAM (RDRAM), direct Rambus dynamic RAM (DRDRAM) and Rambus dynamic RAM (RDRAM).

The technical features in the foregoing embodiments can be combined arbitrarily, and to ease description, not all possible combinations of the technical features have been described, however, as long as there is no contradictory in combination of the technical features, the combinations shall be deemed to fall into the protection scope of the present description.

The foregoing embodiments are only some embodiments of the present invention, the description is concrete and in detail, however, they shall not be understood to be restriction on the protection scope of the present invention. It shall be noted that, for those of ordinary skill in the art, without departing from the technical spirit of the present invention, a plurality of modifications and improvements can be made and the modifications and improvements fall into the protection scope of the present invention. Therefore, the protection scope of the present invention shall be defined by the appended claims.

The foregoing are only some preferred embodiments of the present invention and are not intended to limit the present invention, all modifications, equivalent replacement and improvements made within the spirit and principle of the present invention shall fall into the protection scope of the present invention.

The invention claimed is:

1. A constant load clamping apparatus of injector head of coiled tubing drilling machine, wherein the apparatus comprises:

a ropeslice-rope structure, wherein a first connection piece and a second connection piece are connected at both ends of the ropeslice-rope structure;

a first slice and a second slice are symmetrically provided in the ropeslice-rope structure, the first slice and the second slice are provided in parallel, a rope is provided in between the first slice and the second slice, an end of the first slice, an end of the second slice, and an end of the rope are fixed at a first fixing position of the first connection piece and another end of the first slice, another end of the second slice and another end of the rope are connected at a second fixing position of the second connecting piece.

2. The constant load clamping apparatus of injector head of coiled tubing drilling machine according to claim 1, wherein the first connecting piece is provided in parallel with the second connecting piece, a plurality of the ropeslice-rope structures are installed in between the first connecting piece and the second connecting piece in parallel, and the ropeslice-rope structures are perpendicular to the first connecting piece and the second connecting piece respectively.

3. The constant load clamping apparatus of injector head of coiled tubing drilling machine according to claim 2, wherein the clamping apparatus is installed in parallel in two layers.

4. The constant load clamping apparatus of injector head of coiled tubing drilling machine according to claim 1, wherein the first slice and the second slice are initially flexed, and the rope is subjected to only a tensioning stress.

* * * * *